US011859615B2

(12) United States Patent
Yang et al.

(10) Patent No.: US 11,859,615 B2
(45) Date of Patent: Jan. 2, 2024

(54) SCROLL COMPRESSOR

(71) Applicant: Emerson Climate Technologies (Suzhou) Co., Ltd., Jiangsu (CN)

(72) Inventors: Chun Yang, Suzhou (CN); Hongcai Zheng, Jiangsu (CN); Hongfei Shu, Jiangsu (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 50 days.

(21) Appl. No.: 17/773,813

(22) PCT Filed: Aug. 21, 2020

(86) PCT No.: PCT/CN2020/110360
§ 371 (c)(1),
(2) Date: May 2, 2022

(87) PCT Pub. No.: WO2021/088467
PCT Pub. Date: May 14, 2021

(65) Prior Publication Data

US 2022/0381243 A1 Dec. 1, 2022

(30) Foreign Application Priority Data

Nov. 4, 2019 (CN) ..... 201911065644.8
Nov. 4, 2019 (CN) ..... 201921915060.0

(51) Int. Cl.
*F04C 18/02* (2006.01)
*F04C 27/00* (2006.01)
(Continued)

(52) U.S. Cl.
CPC ..... *F04C 18/0215* (2013.01); *F04C 27/005* (2013.01); *F04C 28/185* (2013.01); *F04C 28/26* (2013.01)

(58) Field of Classification Search
CPC .. F04C 18/0215; F04C 27/005; F04C 28/185; F04C 28/26
See application file for complete search history.

(56) References Cited

U.S. PATENT DOCUMENTS 8,444,403 B2 5/2013 Tang
8,678,797 B2 * 3/2014 Kawano ..... F04C 18/0261 418/57
(Continued)

FOREIGN PATENT DOCUMENTS

CN 103541901 A 1/2014
CN 103790831 A 5/2014
(Continued)

OTHER PUBLICATIONS

English Translation CN-204003448-U (Year: 2014).*
(Continued)

*Primary Examiner* — Shafiq Mian
(74) *Attorney, Agent, or Firm* — Harness, Dickey & Pierce, P.L.C.

(57) ABSTRACT

A scroll compressor comprises a partition plate, a compression mechanism, a capacity adjustment device and a sealing assembly. The sealing assembly isolates a back pressure chamber from a high-pressure space and low-pressure space. A first sealing portion is formed between the sealing assembly and the partition plate. The capacity adjustment device is provided with a variable pressure chamber and configured to establish or break the communication between a first compression chamber and the low pressure space by changing the pressure in the variable pressure chamber. According to the compressor, requirements for pressure in the back pressure chamber of the compressor in different load conditions can be balanced, the axial force on the compression mechanism can be reduced, the power consumption of the
(Continued)

scroll compressor can be lowered, the system performance can be improved, and the manufacturing cost can be reduced.

11 Claims, 11 Drawing Sheets

(51) Int. Cl.
*F04C 28/18* (2006.01)
*F04C 28/26* (2006.01)

(56) References Cited

U.S. PATENT DOCUMENTS

2010/0189585 A1* 7/2010 Matsukawa ..... F04C 18/0215 418/48
2012/0107164 A1* 5/2012 Kawano ..... F04C 28/26 418/55.1
2015/0176585 A1 6/2015 Sun

FOREIGN PATENT DOCUMENTS

| | | | |
|---|---|---|---|
| CN | 204003448 U | * | 12/2014 |
| CN | 207960933 U | | 10/2018 |
| CN | 110067749 A | | 7/2019 |
| CN | 209569164 U | | 11/2019 |
| CN | 111472977 A | | 7/2020 |
| CN | 211009078 U | | 7/2020 |
| JP | 2000097175 A | | 4/2000 |

OTHER PUBLICATIONS

International Search Report (English and Chinese) and Written Opinion of the International Searching Authority (Chinese) issued in PCT/CN2020/110360, dated Nov. 25, 2020; ISA/CN.

* cited by examiner

SCROLL COMPRESSOR

This application is the national phase of International Application No. PCT/CN2020/110360 titled "SCROLL COMPRESSOR" and filed on Aug. 21, 2020, which claims priorities to the Chinese patent applications No. 201911065644.8 and No. 201921915060.0 titled "SCROLL COMPRESSOR" and filed with the China National Intellectual Property Administration on Nov. 4, 2019. These applications are incorporated herein by reference.

FIELD

The present disclosure relates to a scroll compressor.

BACKGROUND

The contents of this section only provide background information related to the present disclosure, which may not constitute the conventional technology.

During the operation of the scroll compressor, working fluid (for example, refrigerant gas) enters the scroll compressor through an air inlet pipe of the scroll compressor, and enters a compression chamber of a compression mechanism with the movement of the compression mechanism, and is compressed by the compression mechanism and discharged from the scroll compressor. In order to better adapt to different terminal load requirements, the scroll compressor is equipped with a capacity adjustment function. At present, the capacity adjustment technology of scroll compressors mainly includes mechanical bypass capacity adjustment technology and frequency conversion adjustment technology. The mechanical bypass capacity adjustment technology realizes the capacity adjustment of the scroll compressor by opening or blocking the bypass channel provided in the compression mechanism, which has the characteristics of low system cost and high reliability, so it is widely used. Under the operating conditions of various loads (for example, partial load conditions and full load conditions), it is necessary to reliably separate the high pressure area, the medium pressure area and the low pressure area in the compression mechanism, so that the scroll compressor can operate effectively.

In a scroll compressor applying mechanical bypass capacity adjustment technology, the high pressure area, the medium pressure area and the low pressure area are formed by arranging a sealing assembly in the compression mechanism, and the moving member is moved along an axial direction of the compression mechanism to open or block the bypass passage by adjusting the force acting on the moving member, so as to adjust the capacity of the scroll compressor. For this scroll compressor, the sealing assembly and moving member need to be reasonably designed in order to balance the requirements of different load conditions, thus further reducing the power consumption of the scroll compressor and improving the performance of the scroll compressor.

SUMMARY

An object of the present disclosure is to solve at least one of the above problems.

An object of the present disclosure is to provide a scroll compressor, which includes: a partition that divides a space inside the scroll compressor into a high pressure space and a low pressure space; a compression mechanism including a fixed scroll and a movable scroll, where the fixed scroll and the movable scroll cooperate with each other to define a series of compression chambers; a capacity adjustment device including a bypass passage and an adjusting member, the bypass passage penetrates through an end plate of the fixed scroll, so that a first end of the bypass passage is opened at a first side of the end plate of the fixed scroll to communicate with a first compression chamber of a series of compression chambers, and a second end of the bypass passage is opened at the an opposite second side of the end plate of the fixed scroll and selectively communicates with the low pressure space, the adjusting member is configured to be movable in an axial direction relative to the fixed scroll to establish or interrupt communication between the first compression chamber and the low pressure space; a back pressure chamber formed between the fixed scroll and the partition and communicates with a second compression chamber of a series of compression chambers via a back pressure passage; and a sealing assembly separating the back pressure chamber from the high pressure space and the low pressure space. A first sealing part is formed between the sealing assembly and the partition, and a sealing surface of the first sealing part is a flexible sealing surface. The capacity adjustment device is provided with a variable pressure chamber and is configured to move the adjusting member in an axial direction relative to the fixed scroll by changing a pressure in the variable pressure chamber.

In one embodiment, at a first sealing portion, a flexible first sealing piece of a sealing assembly is compressed against the partition by a first mounting piece.

The fixed scroll is provided with a cylindrical portion extending in the axial direction from the second side of the end plate, and the cylindrical portion is provided with an outer shoulder portion. The second end of the bypass passage is located at a radially outer side of the cylindrical portion, and a first end of the back pressure passage is opened at the first side of the end plate of the fixed scroll to communicate with the second compression chamber. A second end of the back pressure passage is opened at the outer shoulder portion. The adjusting member is an annular member, which is sealingly engaged with the cylindrical portion, and is movable relative to the cylindrical portion in the axial direction. The back pressure chamber is jointly defined by the cylindrical portion, the partition and the adjusting member.

In an embodiment, a second sealing portion is further formed between the sealing assembly and the partition, and the second sealing portion is located radially outside the first sealing portion. At the second sealing portion, a flexible second sealing piece of the sealing assembly is compressed against the partition by the second mounting piece.

The second sealing piece is compressed between an end of the second mounting piece and the partition and at least a portion of the second sealing piece is in sealing contact with the adjusting member. An axial distance between the end of the second mounting piece and the partition is d1, and an axial distance between an end of the adjusting member and the partition is d2, preferably, $d1>0.7d2$.

The second mounting piece is mounted on the outer shoulder portion, and the second end of the back pressure passage is always communicated with the back pressure chamber. In one embodiment, the second mounting piece is mounted on the outer shoulder portion via an annular retainer. The annular retainer is provided with a notch extending radially inward from an outer periphery of the annular retainer, the notch facing the second end of the back pressure passage.

The cylindrical portion is further provided with an inner shoulder portion and the first mounting piece is mounted on the inner shoulder portion, so that the first sealing portion is located at a radially inner side of the cylindrical portion.

In an embodiment, the sealing assembly further includes an annular second sealing piece and an annular third sealing piece and comprises a second mounting piece and a third mounting piece coupled to each other. The second sealing piece and the third sealing piece are sandwiched between the second mounting piece and the third mounting piece, and wherein an inner peripheral of the second sealing piece and the outer peripheral wall of the cylindrical portion form a second sealing portion. An outer periphery of the third sealing piece and an inner peripheral wall of the adjusting member form a third sealing portion.

The second mounting piece is provided with an annular flange extending radially inward from an inner wall of the second mounting piece. The first mounting piece is mounted on the annular flange.

In an embodiment, the variable pressure chamber is controlled via an electromagnetic switching valve to selectively communicate with the low pressure space or communicate with the back pressure chamber.

When the variable pressure chamber is controlled to communicate with the low pressure space, the adjusting member covers the second end of the bypass passage to interrupt the communication between the first compression chamber and the low pressure space, so that the scroll compressor operates at full load condition. When the variable pressure chamber is controlled to communicate with the back pressure chamber, the adjusting member opens the second end of the bypass passage to establish the communication between the first compression chamber and the low pressure space, so that the scroll compressor operates at partial load condition.

An improved scroll compressor is provided by the present disclosure, which can balance the requirements for the pressure in the back pressure chamber of the compressor under different load conditions, reliably separate the back pressure chamber from the high pressure space and the low pressure space while reducing the axial force on the compression mechanism, thereby reducing the power consumption of the scroll compressor, improving the system performance and reducing the manufacturing cost.

BRIEF DESCRIPTION OF THE DRAWINGS

Hereinafter, the embodiments of the present disclosure are described by way of example only with reference to the drawings. In the drawings, same features or components are indicated by same reference numerals, and the drawings may not be drawn to scale. In the drawings.

DETAILED DESCRIPTION OF THE EMBODIMENTS

Figure 1:
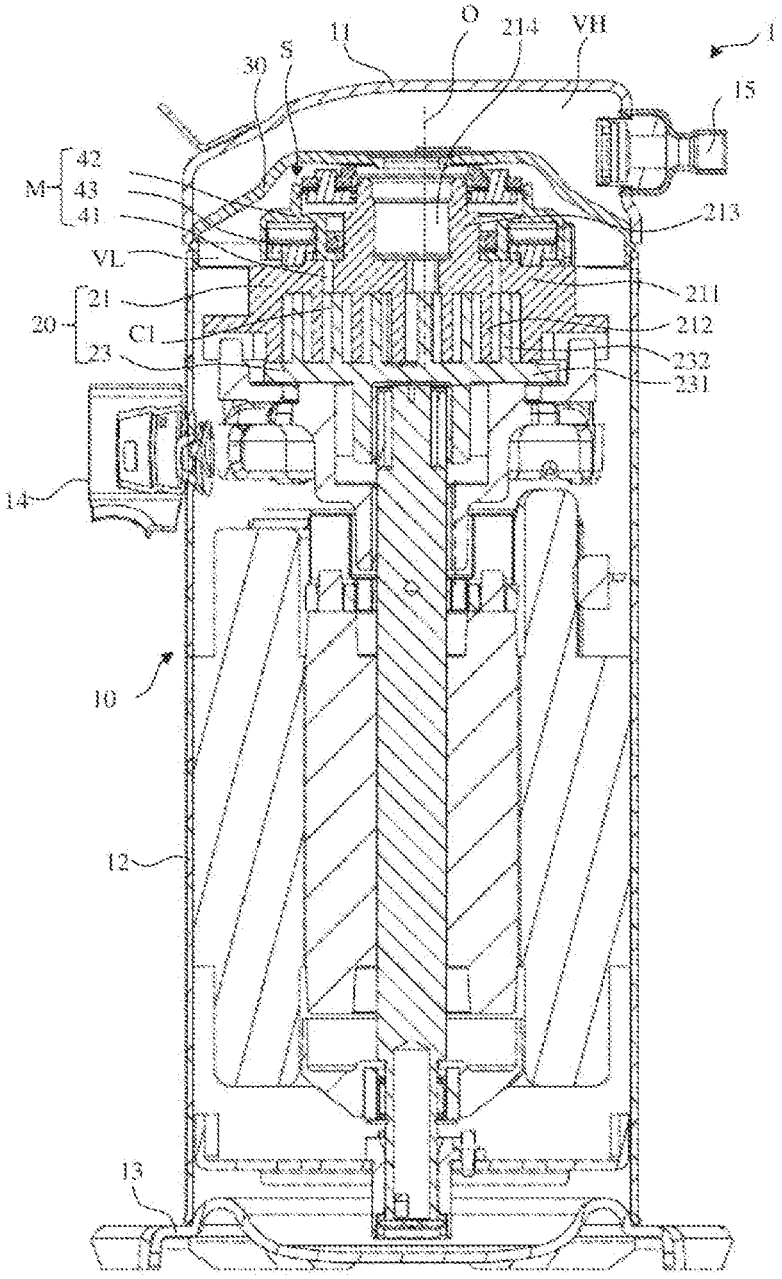
FIG. 1 shows a cross-sectional view of a scroll compressor of a comparative example.

The following description is essentially only illustrative, rather than intending to limit the present disclosure and the application or usage thereof. It should be appreciated that, throughout all drawings, similar reference numerals indicate the same or similar parts or features. Each drawing only illustratively shows the concept and principle of the embodiments of the present disclosure, and does not necessarily show the specific dimensions and scales of various embodiments of the present disclosure. Specific parts in specific drawings may be exaggerated to illustrate related details or structures of various embodiments of the present disclosure.

In the description of the embodiments of the present disclosure, the orientation terms related to "upper", "lower", "left", and "right" used herein are described according to the upper, lower, left and right position relationships of the views shown in the accompanying drawings. In practical applications of the scroll compressor, the positional relationships of "upper", "lower", "left", and "right" used herein may be defined according to actual conditions. These relationships may be reversed.

FIG. 1 shows a cross-sectional view of a scroll compressor 1 of a comparative example. As shown in FIG. 1, the scroll compressor 1 includes a housing assembly 10, a compression mechanism 20 and a partition 30 (for example, a muffler plate) accommodated in the housing assembly 10. The housing assembly 10 includes a top cover 11, a housing 12 and a base 13. The top cover 11, the housing 12 and the base 13 are hermetically coupled to each other to define a sealed space within the housing assembly 10. The partition 30 divides the space inside the housing assembly 10 of the scroll compressor 1 into a high pressure space VH and a low pressure space VL. Specifically, the top cover 11 is sealingly mounted to an upper end of the housing 12, the partition 30 is mounted above the compression mechanism 20 and is sealingly mounted to the inner wall of the housing assembly 10 (either the inner peripheral wall of the top cover 11 or the inner peripheral wall of the housing 12 or both), thereby defining a high pressure space VH between the top cover 11 and the partition 30 in the housing assembly 10 of the scroll compressor 1 and defining a low pressure space VL below the partition 30 in the housing assembly 10.

The compression mechanism 20 includes a fixed scroll 21 and a movable scroll 23. The fixed scroll 21 includes blades 212 extending from the end plate 211 toward the first side (lower side in FIG. 1) and cylindrical portions 213 extending from the end plate 211 toward the opposite second side (upper side in FIG. 1). A radial dimension of the upper end of the cylindrical portion 213 is set to be smaller than a radial dimension of the rest of the cylindrical portion 213, so that an outer shoulder portion 2131 is formed at the upper end of the cylindrical portion 23 (see FIG. 2 and FIG. 3). An exhaust port 214 is provided in the center of the fixed scroll 21, and the exhaust port 214 penetrates through the end plate 211 and the cylindrical portion 213. The exhaust port 214 is provided to have a smaller diameter in the end plate 211 and a larger diameter in the cylindrical portion 213. The movable scroll 23 includes blades 232 extending toward one side (upper side in FIG. 1) from an end plate 231 thereof. The movable scroll 23 is adapted to translate relative to the fixed scroll 21, so that the blades 232 of the movable scroll 23 cooperate with the blades 212 of the fixed scroll 21 to define a series of compression chambers between the movable scroll 23 and the fixed scroll 21. During the operation of the scroll compressor 1, with the compression movement of the compression mechanism 20, the working fluid (for example, refrigerant gas) enters the housing assembly 10 from the air inlet port 14 of the scroll compressor 1, and enters the compression chamber in the compression mechanism 20. The compressed working fluid (for example, high pressure refrigerant gas) exits the compression mechanism 20 from the exhaust port 214 of the fixed scroll 21 and enters the high pressure space VH in the housing assembly 10 of the scroll compressor 1, and leaves the scroll compressor 1 through the exhaust port 15.

The scroll compressor 1 is further provided with a capacity adjustment device M. The capacity adjustment device M includes a bypass passage 41, an annular adjusting member 42 and a mounting piece 43. The bypass passage 41 is formed in the fixed scroll 21 and penetrates through the end plate 211 of the fixed scroll 21. The first end (lower end in FIG. 1) of the bypass passage 41 is opened at the second side (lower side) of the end plate 211 of the fixed scroll 21, so as to communicate with the first compression chamber (for example, the first medium pressure chamber) C1 of a series of compression chambers of the compression mechanism 20 that has a pressure P1. The second end (the upper end in FIG. 1) of the bypass passage 41 is open to the first side of the end plate 211 of the fixed scroll 21 and selectively communicates with the low pressure space VL. The mounting piece 43 is mounted to the fixed scroll 21. The adjusting member 42 is hermetically installed with the fixed scroll 21 and the mounting piece 43 and is provided to be movable in the axial direction O of the compression mechanism 20 relative to the fixed scroll 21 and the mounting piece 43, so as to selectively open or cover the second end of the bypass passage 41, and to establish or interrupt the communication between the first compression chamber C1 and the low pressure space VL, thereby realizing the capacity adjustment of the scroll compressor 1.

Figure 2:
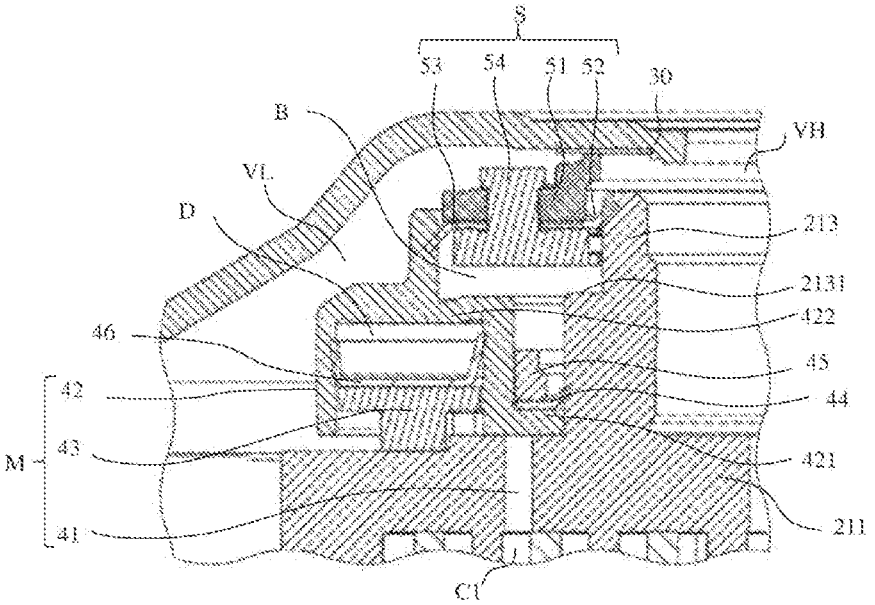
FIG. 2 is a partial enlarged view of FIG. 1, showing a part of the compression mechanism, the sealing assembly and the capacity adjustment device of the scroll compressor under full load condition.
Figure 3:
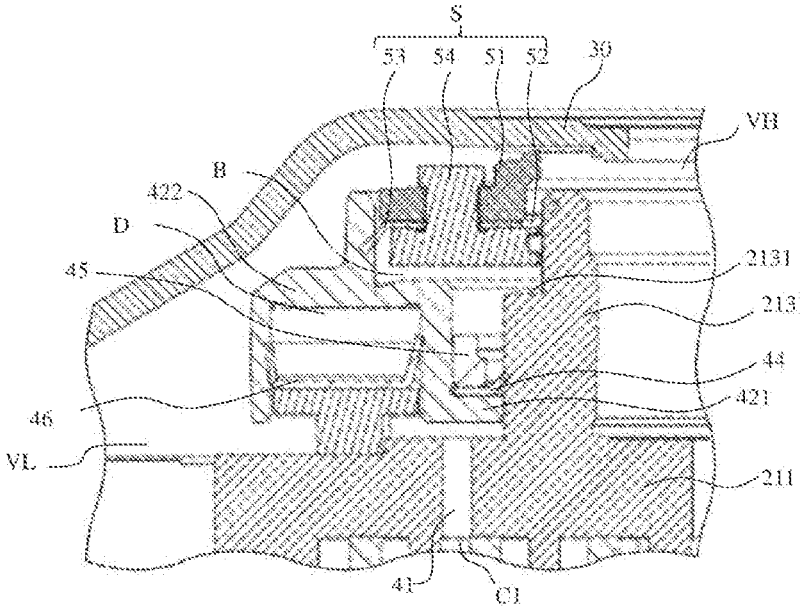
FIG. 3 is a partial sectional view of the scroll compressor of FIG. 1, showing a part of the compression mechanism, the sealing assembly and the capacity adjustment device of the scroll compressor under partial load condition.
Figure 4:
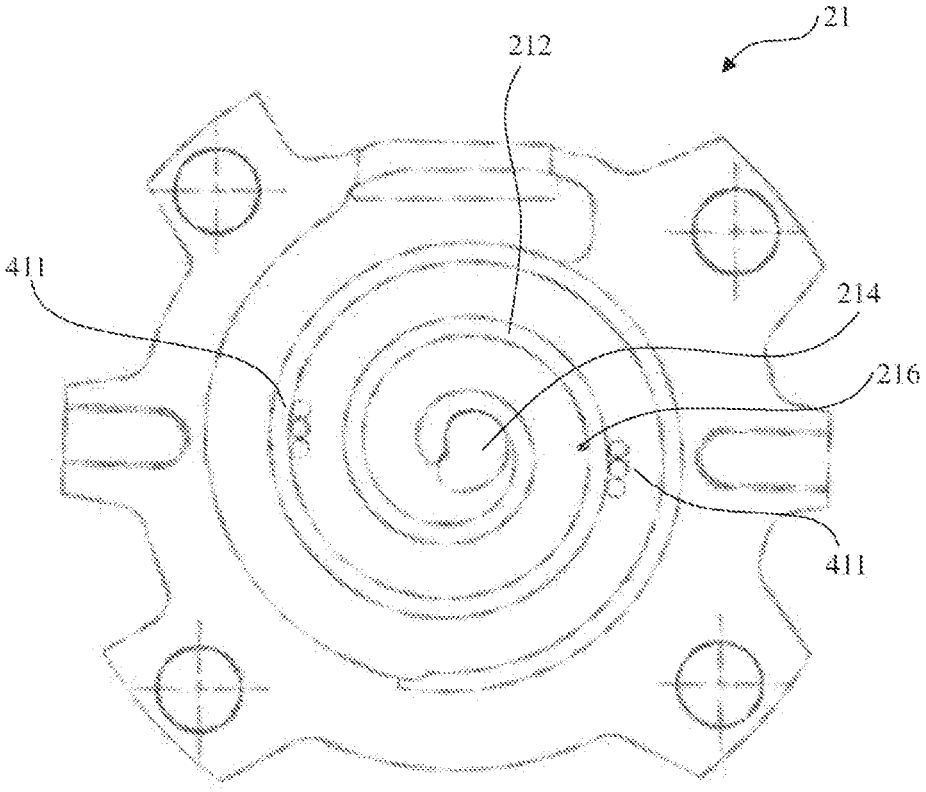
FIG. 4 shows a plan view of the fixed scroll of the scroll compressor of FIG. 1.

FIG. 2 and FIG. 3 show partial sectional views of the scroll compressor 1 in FIG. 1, showing the capacity adjustment device and the sealing assembly S of the scroll compressor 1 under different load conditions. The annular adjusting member 42 includes a first portion 421 and a second portion 422 surrounding the first portion 421. The first portion 421 has a flat bottom surface. The first portion 421 is located directly above the bypass passage 41, and the sealing ring 44 is mounted on the first portion 421 via the fixing member 45. The sealing ring 44 is sandwiched between the fixing member 45 and the first portion 421. The radially inner edge of the sealing ring 44 is sealingly engaged with the outer peripheral wall of the cylindrical portion 213 of the fixed scroll 21, so as to provide a seal between the space above and below the first portion 421. The adjusting member 42 is movable in the axial direction O relative to the cylindrical portion 213, so that the first portion 421 selectively opens or covers the second end of the bypass passage 41. The second portion 422 extends upward in the axial direction O and radially outward from the outer periphery of the first portion 421, thereby forming a first annular recessed portion between the outer peripheral wall of the cylindrical portion 213 and the second portion 422, the opening of which faces the partition 30 and forming a second annular recessed portion in the second portion 422, the opening of which faces the end plate 211 of the fixed scroll 21. The lower end of the first annular recessed portion is sealed by the sealing engagement of the sealing ring 44 with the outer peripheral wall of the cylindrical portion 213 of the fixed scroll 21. The sealing assembly S is installed in the first annular recessed portion whose lower end is sealed, and provides a seal between the partition 30, the fixed scroll 21 and the adjusting member 42, thereby forming a back pressure chamber B in the first annular recessed portion. The sealing assembly S includes a first sealing piece 51, a second sealing piece 52, a third sealing piece 53 and a first mounting piece 54. The first sealing piece 51 and the first mounting piece 54 are engaged (e.g., riveted) to each other, and sandwich the second sealing piece 52 and the third sealing piece 53 therebetween. The upper end of the first sealing piece 51 abuts against the partition 30 to form a first sealing portion, thereby separating the high pressure space VH and the low pressure space VL in the scroll compressor 1. The inner periphery of the second sealing piece 52 abuts against the cylindrical portion 213 of the fixed scroll 21 to form a second sealing portion, and the outer periphery of the third sealing piece 53 abuts against the second portion 422 of the adjusting member 42 to form a third sealing portion, thereby forming a back pressure chamber B in the first annular recessed portion between the outer peripheral wall of the cylindrical portion 21 and the second portion 422, the back pressure chamber B communicates with a back pressure passage (not shown) formed in the fixed scroll 21. The first end (lower end) 216 of the back pressure passage (only shown in FIG. 4) communicates with the second compression chamber (for example, the second medium pressure chamber) of a series of compression chambers of the compression mechanism 20 that has a pressure P2, thereby providing back pressure (i.e., pressure P2) to the back pressure chamber B. FIG. 4 shows a plan view of the fixed scroll 21 of the scroll compressor 1 as viewed from the blade 212 side of the fixed scroll 21, showing the first end 216 of the back pressure passage and the first end 411 of the bypass passage 41. To prevent the back pressure passage from being covered by the first portion 421 of the adjusting member 42, the back pressure passage is at least partially formed in the cylindrical portion 213 of the fixed scroll 21, so that the second end (upper end, not shown) of the back pressure passage is exposed from the outer shoulder portion 2131 of the cylindrical portion 213.

The mounting piece 43 is sealingly mounted within a second annular recessed portion in the second portion 422 of the adjusting member 42, and is mounted on the end plate 211 of the fixed scroll 21, the annular sealing piece 46 is mounted on the mounting piece 43. The annular sealing piece 46 abuts against the side wall of the second annular recessed portion, thereby forming an annular variable pressure chamber D within the second annular recessed portion. The annular variable pressure chamber D may selectively communicate with the low pressure space VL or the back pressure chamber B in the compression mechanism 20 to change the pressure P3 in the variable pressure chamber D. When the variable pressure chamber D communicates with the low pressure space VL, the pressure P3 in the variable pressure chamber D is a relatively low intake pressure, so that the resultant force of the upward force acting on the adjusting member 42 is insufficient to overcome the resultant force of the downward force acting on the adjusting member 42. The adjusting member 42 moves downward so that the first portion 421 of the adjusting member 42 rests on the surface of the end plate 211 of the fixed scroll 21, thereby blocking the bypass passage 41, as shown in FIG. 2. At this time, the communication between the first compression chamber C1 and the low pressure space VL is interrupted, and the scroll compressor 1 operates in a full load condition. The upward resultant force acting on the adjusting member 42 includes the upward force acting on the adjusting member 42 by the bypass passage 41, the upward force acting on the adjusting member 42 by the low pressure space VL and the upward force acting on the adjusting member 42 by the variable pressure chamber D. The downward resultant force acting on the adjusting member 42 includes the gravity of the adjusting member 42 itself, the downward force acting on the adjusting member 42 by the low pressure space VL and the downward force acting on the adjusting member 42 by the back pressure chamber B. When the variable pressure chamber D communicates with the back pressure chamber B, the pressure P3 in the variable pressure chamber D is the back pressure (pressure P2) in the back pressure chamber B. The resultant upward force acting on the adjusting member 42 can overcome the resultant downward force acting on the adjusting member 42. The adjusting member 42 moves upward away from the end plate 211 of the fixed scroll 21 in the axial direction O relative to the fixed scroll 21, the mounting piece 43 and the annular sealing piece 46 to open the bypass passage 41, as shown in FIG. 3. The first compression chamber C1 communicates with the low pressure space VL, and the scroll compressor 1 operates at a partial load.

In the scroll compressor 1, the sealing assembly S is designed as a floating sealing ring, and the first sealing portion between the sealing assembly S and the partition 30 is a metal contact surface. During the operation of the scroll compressor 1, in order to reliably separate the high pressure space VH and the low pressure space VL, the contact force of the first sealing portion needs to be set larger. Under partial load condition, in order to provide reliable sealing at the first sealing portion between the first sealing piece 51 and the partition 30 to separate the high pressure space VH from the low pressure space VL, it is often necessary to set the back pressure (pressure P2) in the back pressure chamber B to be relatively high, and it is necessary to set the first end 216 of the back pressure passage communicating with the back pressure chamber B to be closer to the central area of the blade 212 of the fixed scroll 21, as shown in FIG. 4. However, when the scroll compressor 1 operates at full load, it is often desired that the back pressure (pressure P2) in the back pressure chamber B be relatively low to reduce the axial force of the compression mechanism 20, thereby reducing the power consumption of the scroll compressor 1 and ensuring the system performance. Therefore, the requirements for the pressure in the back pressure chamber B of the scroll compressor 1 are significantly different under partial load conditions and under full load conditions. In addition, since the first sealing portion between the first sealing piece 51 and the partition 30 separates the high pressure space VH and the low pressure space VL, the pressure difference between the two sides of the sealing portion is large, and it is further required to set the back pressure (pressure P2) in the back pressure chamber B to be relatively high, so that the difference in the requirements for the back pressure (pressure P2) in the back pressure chamber B under different load conditions are further enlarged. In addition, the manufacturing and processing requirements of each component of the above-mentioned sealing assembly S are also strict, and the cost is relatively high. In addition, the metal sealing surface is prone to rust which is also a problem.

Therefore, it is necessary to improve the sealing assembly and capacity adjustment device of the scroll compressor to balance the requirements for the pressure in the back pressure chamber under different working conditions. Under the condition of ensuring sealing, it is desirable to reduce the axial force of scroll compressor, reduce the power consumption of compressor, improve the system performance and reduce the manufacturing cost as much as possible.

In view of the above problems, the present inventor proposes an improved scroll compressor, and the difference between the requirements for the pressure of the back pressure chamber under different load conditions is favorably alleviated by reasonably designing the capacity adjustment device and the sealing assembly arranged between the capacity adjustment device, the fixed scroll and the partition. It is possible to reduce the axial force of the scroll compressor under full load condition, reduce the power consumption of the compressor, improve the system performance and reduce the manufacturing cost while ensuring reliable sealing. The scroll compressor according to the present disclosure is described below with reference to the accompanying drawings.

Figure 5:
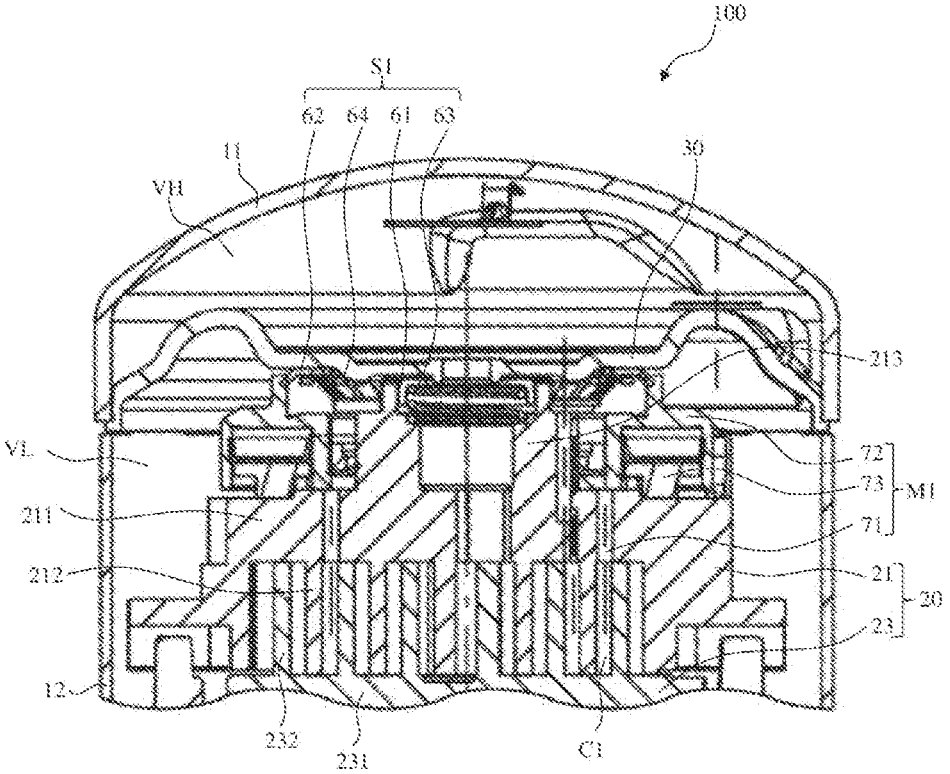
FIG. 5 shows a partial cross-sectional view of a scroll compressor according to a first embodiment of the present disclosure.
Figure 6:
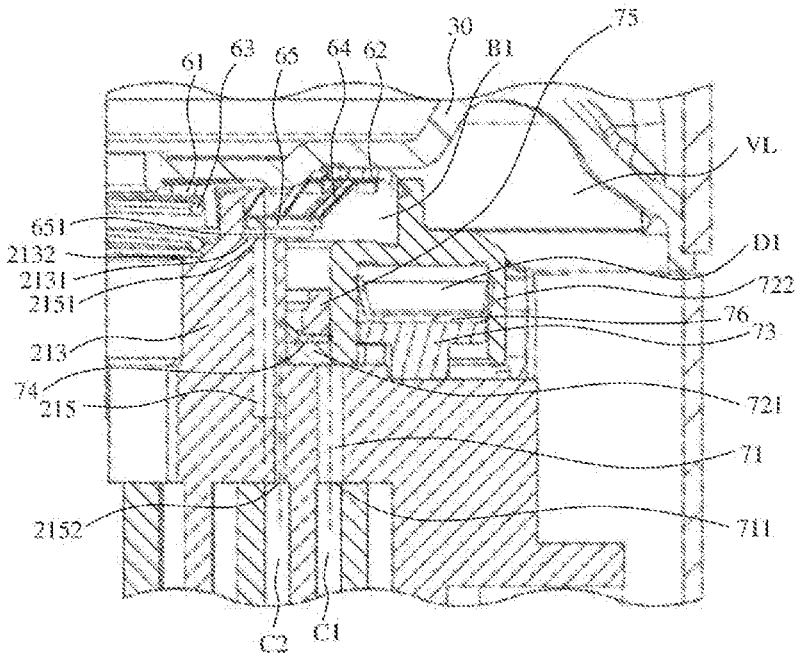
FIG. 6 is a partial enlarged view of FIG. 5, showing a part of the compression mechanism, the sealing assembly and the capacity adjustment device of the scroll compressor under full load condition.
Figure 7:
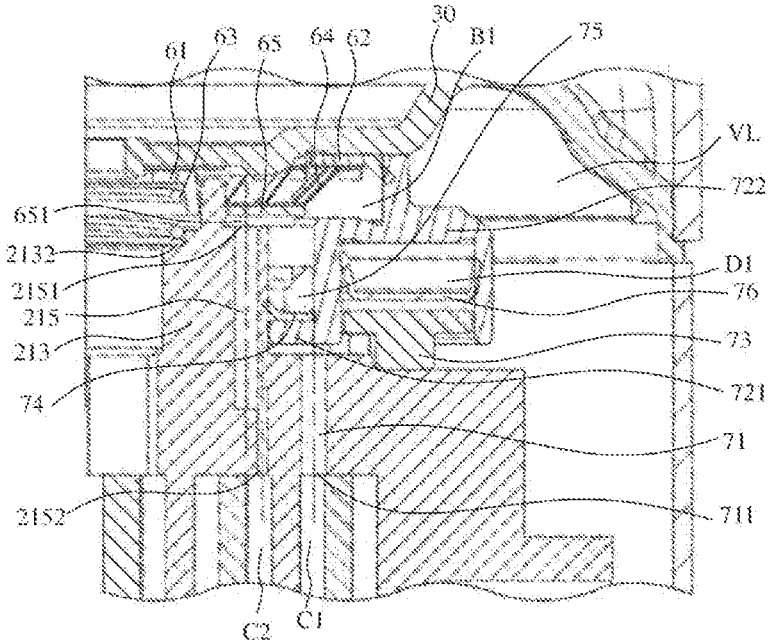
FIG. 7 is a partial sectional view of the scroll compressor of FIG. 5, showing a part of the compression mechanism, the sealing assembly and the capacity adjustment device of the scroll compressor under partial load condition.

FIG. 5 to FIG. 7 illustrates partial cross-sectional views of the scroll compressor 100 according to the first embodiment of the present disclosure. FIG. 6 and FIG. 7 show the compression mechanism 20, the partition 30, the capacity adjustment device M1 and the sealing assembly S1 mounted between these components of the scroll compressor 100 under different load conditions, respectively. The scroll compressor 100 according to the first embodiment of the present disclosure is different from the scroll compressor 1 of the comparative example in the design of the capacity adjustment device and the sealing assembly, and the other aspects are generally the same. In the drawings, the same elements as those of the scroll compressor 1 of the comparative example are denoted by the same reference numerals, and the description are not repeated. Only the differences between the scroll compressor 100 according to the first embodiment of the present disclosure and the scroll compressor 1 of the comparative example are described below.

As shown in FIG. 5 to FIG. 7, the capacity adjustment device M1 of the scroll compressor 100 includes a bypass passage 71, an annular adjusting member 72 and a mounting piece 73. The bypass passage 71 is formed in the fixed scroll 21 and penetrates through the end plate 211 of the fixed scroll 21. The first end 711 (lower end in FIG. 5 to FIG. 7) of the bypass passage 71 is opened at the first side (lower side in the figure) of the end plate 211 of the fixed scroll 21, so as to communicate with the first compression chamber (for example, the first medium pressure chamber) C1 of a series of compression chambers of the compression mechanism 20 that has a pressure P1. The second end (the upper end in FIG. 5 to FIG. 7) of the bypass passage 71 is open at the second side (the upper side in the figure) of the end plate 211 of the fixed scroll 21 and selectively communicates with the low pressure space VL in the scroll compressor 100. The first portion 721 of the adjusting member 72 is located directly above the second end of the bypass passage 71, and the sealing ring 74 is mounted on the first portion 721 via the fixing member 75. The sealing ring 74 is sandwiched between the fixing member 75 and the first portion 721. The radially inner edge of the sealing ring 74 is sealingly engaged with the outer peripheral wall of the cylindrical portion 213 of the fixed scroll 21, so as to provide a seal between the space above and below the first portion 721. The adjusting member 72 is movable in the axial direction relative to the cylindrical portion 213 of the fixed scroll 21, so that the first portion 721 selectively opens or covers the second end of the bypass passage 71. The second portion 722 of the adjusting member 72 extends radially outward and axially upward from the outer periphery of the first portion 721, and a first annular recessed portion whose opening faces the partition 30 is formed between the outer peripheral wall of the cylindrical portion 213 of the fixed scroll 21 and the second portion 722 of the adjusting member 72. A second annular recessed portion whose opening faces the end plate 211 of the fixed scroll 21 is formed in the second portion 722. The lower end of the first annular recessed portion is sealed by the sealing engagement of the sealing ring 74 with the outer peripheral wall of the cylindrical portion 213 of the fixed scroll 21. However, the present disclosure is not limited thereto. In other examples of the present disclosure, in the case where the first portion 721 of the adjusting member 72 has a sufficient thickness, a sealing piece may be provided between the radially inner end face of the first portion 721 of the adjusting member 72 and the outer peripheral wall of the cylindrical portion 213 of the fixed scroll 21. For example, an annular groove is provided in the radially inner end face of the first portion 721 of the adjusting member 72 and an annular sealing piece is provided in the annular groove, so that the radially inner end face of the first portion 721 of the adjusting member 72 is sealingly engaged with the outer peripheral wall of the cylindrical portion 213 of the fixed scroll 21.

Figure 8:
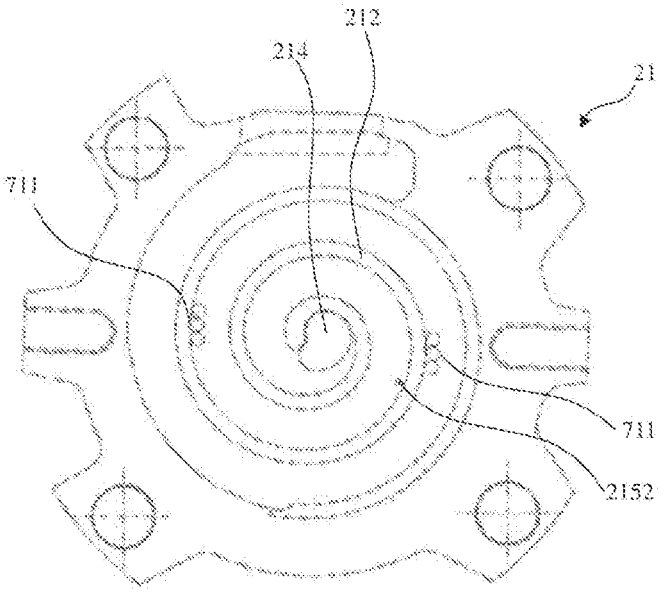
FIG. 8 shows a plan view of the fixed scroll of the scroll compressor of FIG. 5.

The sealing assembly S1 is installed in the first annular recessed portion whose lower end is sealed, and provides a seal between the partition 30, the fixed scroll 21 and the adjusting member 72, thereby forming a back pressure chamber B1 in the first annular recessed portion. The sealing assembly S1 adopts a flat-top sealing ring design, and includes a first sealing piece 61, a second sealing piece 62, a first mounting piece 63 and a second mounting piece 64. Both the first sealing piece 61 and the second sealing piece 62 are flexible sealing pieces, and both the first mounting piece 62 and the second mounting piece 64 are compression springs. The first sealing piece 61 is mounted between the cylindrical portion 213 of the fixed scroll 21 and the partition 30. The first mounting piece 63 abuts the first sealing piece 61 against the partition 30 to form a first sealing portion, and at least a part of the first sealing piece 61 abuts against the inner wall of the cylindrical portion 213. The upper end of the cylindrical portion 213 of the fixed scroll 21 is further formed with an inner shoulder portion 2132. The first mounting piece 63 is mounted on the inner shoulder portion 2132, so that the first sealing portion between the first sealing piece 61 and the partition 30 is located radially inside the cylindrical portion 213. The second sealing piece 62 is installed between the partition 30 and the adjusting member 72, and the second mounting piece 64 presses the second sealing piece 62 against the partition 30 to form a second sealing portion. The second sealing portion is located radially outside the first sealing portion, and at least a part of the second sealing piece 62 abuts against the second portion 722 of the adjusting member 72, thereby forming a back pressure chamber B1 in the first annular recessed portion between the outer peripheral wall of the cylindrical portion 213 of the fixed scroll 21 and the second portion 722 of the adjusting member 72. The back pressure chamber B1 communicates with the second compression chamber (for example, the second medium pressure chamber) C2 of a series of compression chambers of the compression mechanism 20 that has a pressure P2 via a back pressure passage 215 formed in the fixed scroll 21. The first end (lower end) 2152 of the back pressure passage 215 is exposed from the lower surface of the end plate 211 of the fixed scroll 21 and communicates with the second compression chamber C2, and the second end (upper end) 2151 of the back pressure passage 215 is exposed from the outer shoulder portion 2131 of the cylindrical portion 213 of the fixed scroll 21. FIG. 8 shows a plan view of the fixed scroll 21 of the scroll compressor 100 as viewed from the blade 212 side of the fixed scroll 21, showing the first end 2152 of the back pressure passage 215 and the first end 711 of the bypass passage 71.

The mounting piece 73 is sealingly mounted in a second annular recessed portion in the second portion 722 of the adjusting member 72, and is mounted on the end plate 211 of the fixed scroll 21, the annular sealing piece 76 is mounted on the mounting piece 73. The annular sealing piece 76 abuts against the side wall of the second annular recessed portion, thereby defining an annular variable pressure chamber D1 within the second annular recessed portion. The variable pressure chamber D1 selectively communicates with the low pressure space VL in the compression mechanism 20 or communicates with the back pressure chamber B1 to change the pressure P3 in the variable pressure chamber D1. When the variable pressure chamber D1 communicates with the low pressure space VL, the pressure P3 in the variable pressure chamber D1 is the relatively low intake pressure, the resultant upward force acting on the adjusting member 72 may not overcome the resultant downward force acting on the adjusting member 72. The adjusting member 72 moves downward in the axial direction with respect to the fixed scroll 21, the mounting piece 73 and the annular sealing piece 76 so that the first portion 721 of the adjusting member 72 rests on the surface of the end plate 211 of the fixed scroll 21, thereby blocking the bypass passage 71, as shown in FIG. 6. At this time, the communication between the first compression chamber C1 and the low pressure space VL is interrupted, and the scroll compressor 100 operates in a full load condition. The upward resultant force acting on the adjusting member 72 includes the upward force acting on the adjusting member 72 by the bypass passage 71, the upward force acting on the adjusting member 72 by the low pressure space VL and the upward force acting on the adjusting member 72 by the variable pressure chamber D1. The downward resultant force acting on the adjusting member 72 includes the gravity of the adjusting member 72 itself, the downward force acting on the adjusting member 72 by the low pressure space VL and the downward force acting on the adjusting member 72 by the back pressure chamber B1. When the variable pressure chamber D1 communicates with the back pressure chamber B1, the pressure P3 in the variable pressure chamber D1 is the back pressure (pressure P2) in the back pressure chamber B1. The resultant upward force acting on the adjusting member 72 can overcome the resultant downward force acting on the adjusting member 72. The adjusting member 72 moves upward away from the end plate 211 of the fixed scroll 21 in the axial direction relative to the fixed scroll 21 and the mounting piece 73 to open the bypass passage 71, as shown in FIG. 7. At this time, the first compression chamber C1 communicates with the low pressure space VL, and the scroll compressor 1 operates at a partial load.

Figure 9:
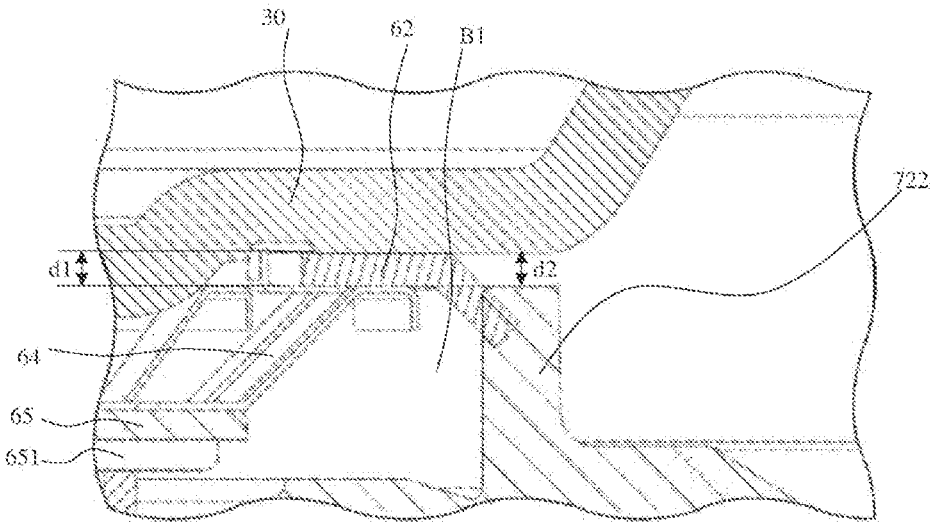
FIG. 9 is a partial enlarged view of FIG. 5, showing the seal between the sealing assembly and the partition.

FIG. 9 shows a partial enlarged view of FIG. 7 showing the installation between the second sealing piece 62 of the sealing assembly S1 and the partition 30 and the adjusting member 72. As shown in FIG. 9, the second mounting piece 64 abuts the second sealing piece 62 against the partition 30 and the second portion 722 of the adjusting member 72. The second sealing piece 62 is compressed between the top of the second mounting piece 64 and the partition 30, and at least a portion of the second sealing piece 62 is in sealing contact with the second portion of the adjusting member 72. The axial spacing between the top of the second mounting piece 64 and the partition 30 (i.e., the thickness of the second sealing piece 62 in the compressed state) is d1, and the axial spacing between the top of the second portion 722 of the adjusting member 72 and the partition 30 is d2. In order to prevent the second sealing piece 62 from being blown out of the back pressure chamber B1, d1 and d2 are designed to satisfy the following relationship: $d1>0.7d2$. In addition, the thickness of the second sealing piece 62 in the uncompressed state is set to be greater than the axial distance d1 between the top of the second mounting piece 64 and the partition 30, so that the second sealing piece 62 is in a compressed state when mounted between the second mounting piece 64 and the partition 30, thereby ensuring sealing.

Figure 10:
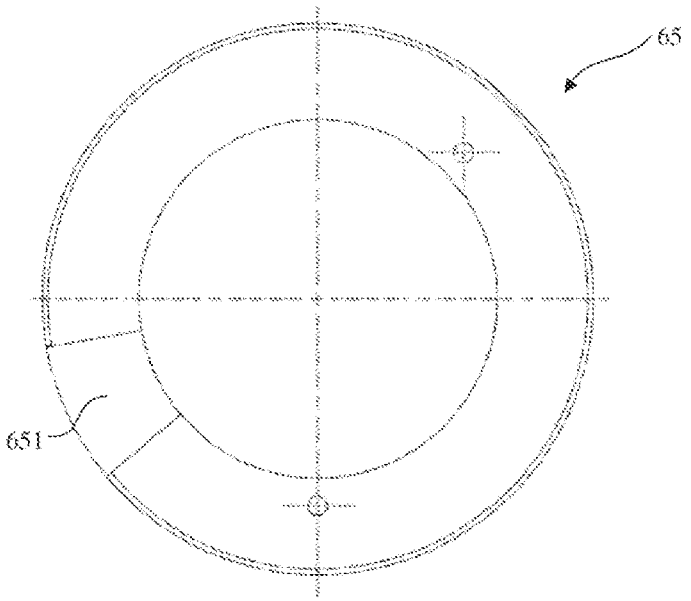
FIG. 10 shows a plan view of the annular retainer of the sealing assembly of the scroll compressor of FIG. 5.

The second mounting piece 64 is mounted on the outer shoulder portion 2131 and the second end 2151 of the back pressure passage 215 is always communicated with the back pressure chamber B1. In this example, in order to prevent the second mounting piece 64 from covering the second end 2151 of the back pressure passage 215 when mounted on the outer shoulder portion 2131 of the cylindrical portion 213 of the fixed scroll 21, the second mounting piece 64 is mounted to the outer shoulder portion 21 of the fixed scroll 21 via the annular retainer 65 (see FIG. 6, FIG. 7 and FIG. 9). FIG. 10 shows a plan view of the annular retainer 65, the annular retainer 65 is provided with a notch 651 extending radially inward from the outer periphery of the annular retainer 65. When the annular retainer 65 is mounted on the outer shoulder portion 21 of the fixed scroll 21, the notch 651 is located directly above the second end 2151 of the back pressure passage 215 and faces the second end 2151 of the back pressure passage 215, so that the back pressure chamber B1 is always kept in communication with the back pressure passage 215. The notch 651 may penetrate the entire thickness of the annular retainer 65, or may extend from one side surface of the annular retainer 65 in the thickness direction of the annular retainer 65 without penetrating the annular retainer 65. However, the present disclosure is not limited to this. In the case that the annular lower end of the second mounting piece 64 has sufficient radial size and sufficient rigidity can be ensured, the annular retainer 65 may not be provided. Instead, a through hole or groove directly facing the upper end 2151 of the back pressure passage 215 is provided at the annular lower end of the second mounting piece 64, so that the back pressure chamber B1 is always in communication with the back pressure passage 215.

Figure 11:
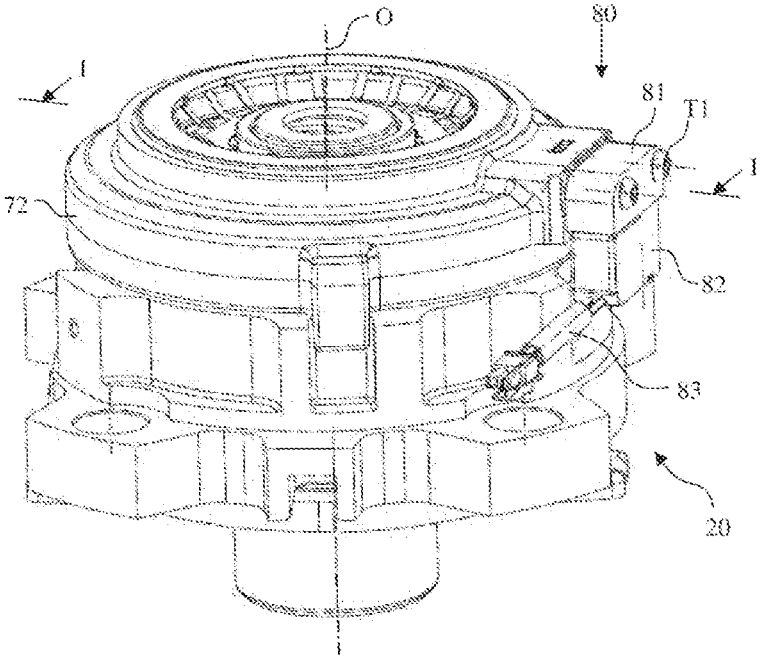
FIG. 11 shows a perspective view of a compression mechanism with an electromagnetic switching valve installed.
Figure 12:
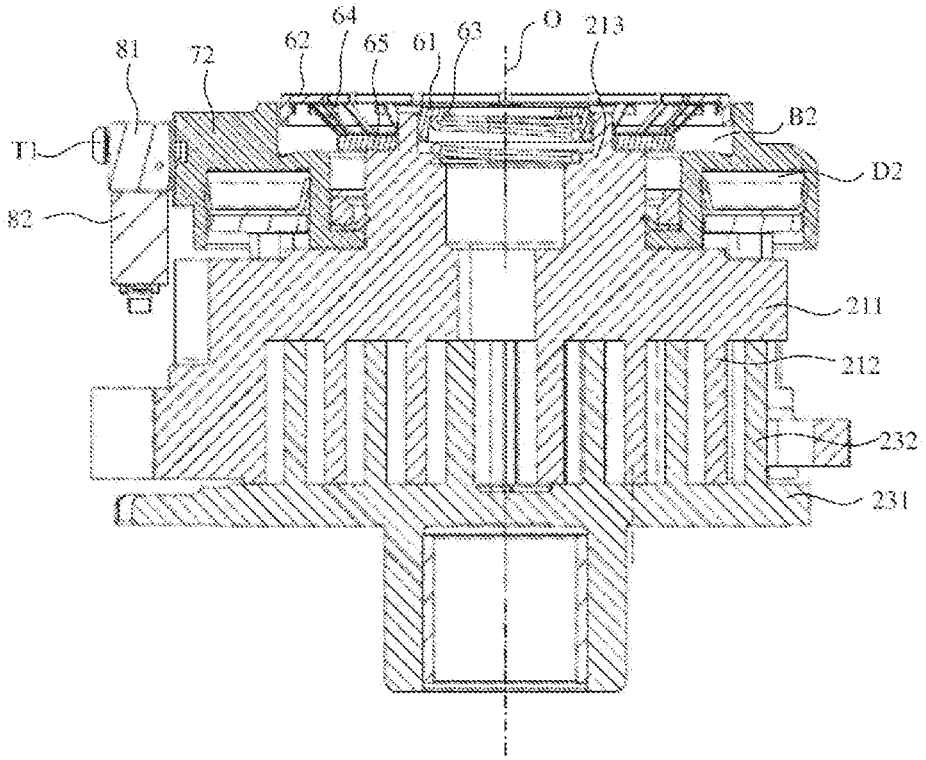
FIG. 12 shows a sectional view taken along section line I-I in FIG. 11.

In the scroll compressor 100, the variable pressure chamber D1 is selectively communicated with the low pressure space VL or the back pressure chamber B1 via the electromagnetic switching valve 80, so that the pressure P3 in the variable pressure chamber D1 is the intake pressure or the relatively high back pressure (pressure P2). FIG. 11 shows a perspective view of the electromagnetic switching valve 80 and the compression mechanism 20 being mounted together, FIG. 12 shows a cross-sectional view taken along the section line I-I in FIG. 11. As shown in FIG. 11 and FIG. 12, the electromagnetic switching valve 80 is mounted to the outer peripheral wall of the adjusting member 72 via the first set of screws T1.

Figure 13:
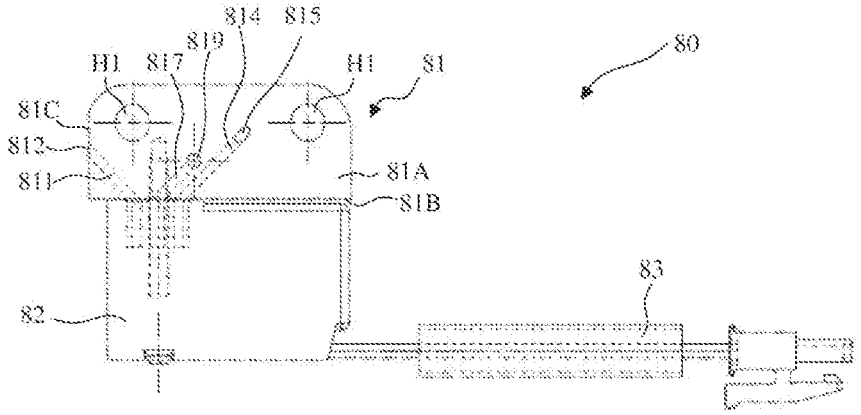
FIG. 13 and FIG. 14 show plan views of the electromagnetic switching valve in FIG. 11 from different angles.
Figure 14:
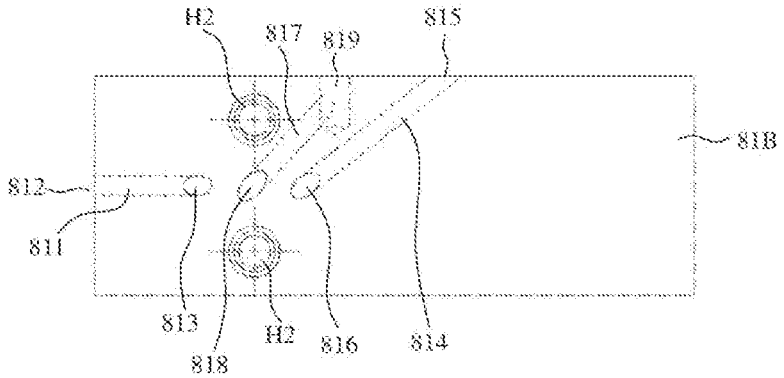

FIG. 13 and FIG. 14 show schematic diagrams of the electromagnetic switching valve 80. The electromagnetic switching valve 80 is a two-position three-way electromagnetic valve, and includes a first valve body part 81, a second valve body part 82, and a control line 83 which are coupled to each other. The first valve body part 81 has a first surface 81A, a second surface 81B, and a third surface 81C. The first surface 81A is provided with a first set of mounting holes H1, the first set of screws T1 pass through the first set of mounting holes H1 on the first surface 81A respectively to mount the first valve body part 81 to the outer peripheral wall of the second portion 722 of the adjusting member 72. The second surface 81B is provided with a second set of mounting holes H2, a second set of screws (not shown) pass through the second valve body part 82 and is screwed into the second set of mounting holes H2 on the second surface 81B of the first valve body part 81, so as to couple the first valve body part 81 and the second valve body part 82 of the electromagnetic switching valve 80 to each other. A first inlet passage 811, a second inlet passage 814 and an outlet passage 817 are provided in the first valve body part 81. The first port 812 of the first inlet passage 811 is opened at the third surface 81C and communicates with the low pressure space VL, the second port 813 of the first inlet passage 811 is opened at the second surface 81B. The first port 815 of the second inlet passage 814 is opened at the first surface 81A, and communicates with the back pressure chamber B1 via a first through hole (not shown) on the adjusting member 72, and thus communicates with the second compression chamber C2 of the compression mechanism 20. The second port 816 of the second inlet passage 814 is opened at the second surface 81B. The first port 818 of the outlet passage 817 is opened at the second surface 81B, the second port 819 of the outlet passage 817 is opened at the first surface 81A, and communicates with the variable pressure chamber D1 via a second through hole (not shown) on the adjusting member 72. A valve core (not shown) of the electromagnetic switching valve 80 is controlled to selectively communicate the outlet passage 817 with the first inlet passage 811 or with the second inlet passage 814. When the outlet passage 817 communicates with the first inlet passage 811, the pressure P3 in the variable pressure chamber D1 is the intake pressure. When the outlet passage 817 communicates with the second inlet passage 814, the pressure P3 in the variable pressure chamber D1 is equal to the back pressure (pressure P2) in the back pressure chamber B1. However, the present disclosure is not limited to this, and the pressure P3 in the variable pressure chamber D1 does not have to be equal to the back pressure (pressure P2) in the back pressure chamber B1. In other embodiments according to the present disclosure, the second inlet passage 814 of the electromagnetic switching valve 80 may be arranged to communicate with other medium pressure chambers in the series of compression chambers of the compression mechanism 20 instead of communicating with the back pressure chamber B1.

The scroll compressor 100 according to the first embodiment of the present disclosure has been described above with reference to FIG. 5 to FIG. 14. In the scroll compressor 100 according to the first embodiment of the present disclosure, the sealing assembly S1 adopts the design of a flat-top sealing ring, and a first sealing portion and a second sealing portion are formed between the sealing assembly 51 and the partition 30. The sealing surfaces of the first sealing portion and the second sealing portion are both flexible sealing surfaces, so that the requirements for the contact force of each sealing surface can be reduced, and the pressure in the back pressure chamber B1 can be designed to be relatively small. Therefore, compared with the scroll compressor 1 of the comparative example, as can be seen from the comparison of FIG. 4 and FIG. 8, the second end 2152 of the back pressure passage 215 can be arranged closer to the outer periphery of the blades 212 of the fixed scroll 21, so that the back pressure (pressure P2) is relatively small. With this arrangement, the axial force in the compression mechanism 20 can be reduced when the scroll compressor 100 operates under full load conditions, the difference between the requirements for the pressure in the back pressure chamber B1 under different load conditions can be alleviated, the power consumption can be reduced and the system performance can be improved. Furthermore, compared with the sealing assembly S in the scroll compressor 1 of the comparative example, the sealing assembly S1 itself of the scroll compressor 100 according to the first embodiment of the present disclosure is less difficult to manufacture and process, and the manufacturing cost can be reduced.

The first sealing portion between the first sealing piece 61 and the partition 30 separates the high pressure space VH and the back pressure chamber B1 (medium pressure space) in the scroll compressor 100 the second sealing portion between the second sealing piece 62 and the partition 30 separates the back pressure chamber B1 (medium pressure space) and the low pressure space VL in the scroll compressor 100. There is no direct leakage passage between the high pressure space VH and the low pressure space VL in the scroll compressor 100. Therefore, this design itself may also reduce the contact force requirement of each sealing portion, thereby helping to set the back pressure (pressure P2) in the back pressure chamber B1 to be relatively small, which is beneficial to alleviate the difference between the requirements for the back pressure (pressure P2) in the back pressure chamber B1 under different load conditions.

In addition, in the scroll compressor 100 according to the first embodiment of the present disclosure, the first sealing piece 61 is provided on the radially inner side of the cylindrical portion 213 of the fixed scroll 21, so the cross-sectional area of the back pressure chamber B1 that is perpendicular to the axial direction of the compression mechanism 20 can be set to be relatively small. Due to the reduced cross-sectional area, the axial force on the compression mechanism 20 can be reduced even when the back pressure (pressure P2) in the back pressure chamber B1 is constant. Therefore, this arrangement optimizes the design of the back pressure chamber B1, which further facilitates reducing the axial force on the compression mechanism 20.

In addition, by adopting the arrangement that the first mounting piece 63 abuts the first sealing piece 61 against the partition 30 and the cylindrical portion 213 of the fixed scroll 21 and the second mounting piece 64 abuts the second sealing piece 62 against the partition 30 and the adjusting member 72, it is helpful to seal the back pressure chamber B1. In addition, by mounting the second mounting piece 64 on the outer shoulder portion 2131 of the fixed scroll 21 through the annular retainer 65 with the notch 651, it is helpful to maintain the communication between the back pressure chamber B1 and the back pressure passage 215, so as to establish the back pressure in the back pressure chamber B1, and thus facilitates the pressure adjustment of the variable pressure chamber D1.

The scroll compressor 200 according to the second embodiment of the present disclosure is described below with reference to FIG. 15 and FIG. 16. The scroll compressor 200 according to the second embodiment of the present disclosure is different from the scroll compressor 1 shown in FIG. 1 to FIG. 4 and the scroll compressor 100 shown in FIG. 5 to FIG. 14 in the design of the capacity adjustment device and the sealing assembly, and the other aspects are basically the same. Therefore, only the differences are shown in the drawings, and the same elements as scroll compressor 1 and scroll compressor 100 are denoted by the same reference numerals, and the differences are mainly described in the following, and the description of the same parts are not repeated.

Figure 15:
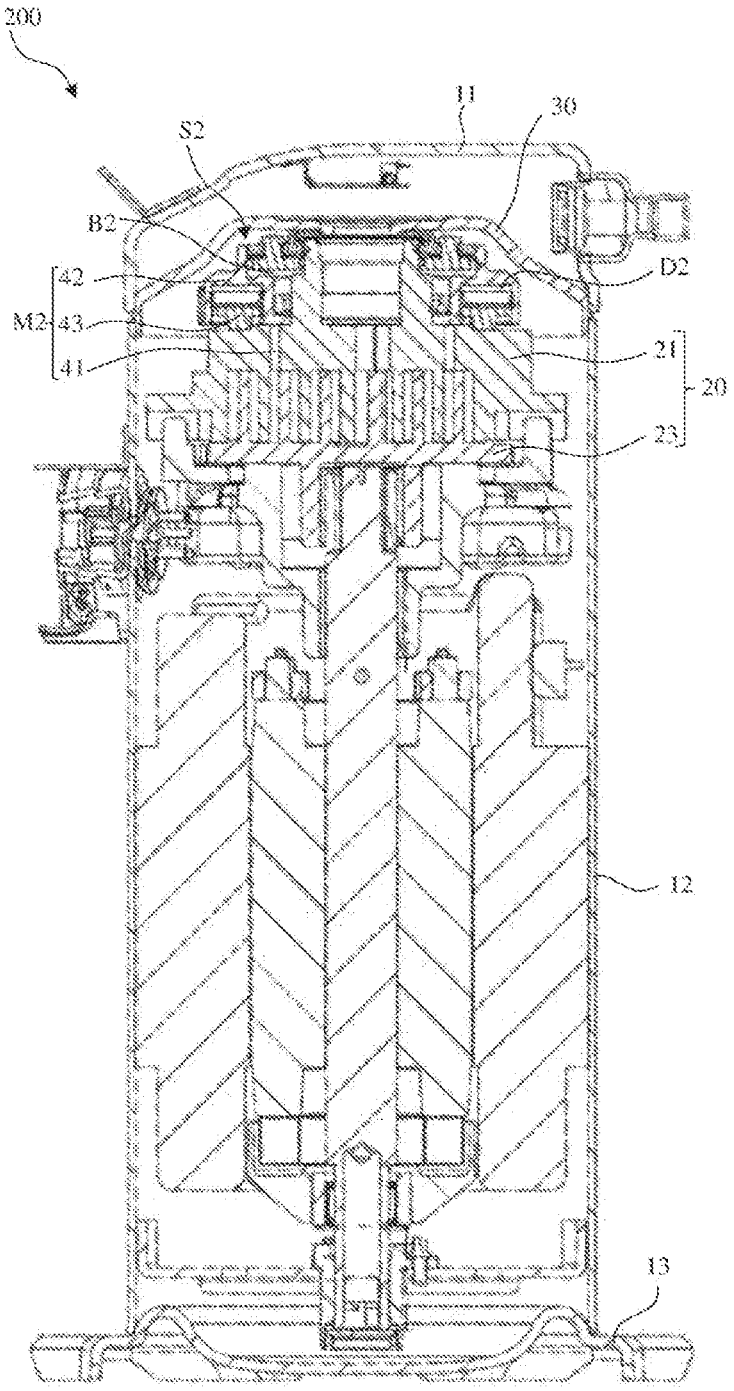
FIG. 15 shows a cross-sectional view of a scroll compressor according to a second embodiment of the present disclosure.
Figure 16:
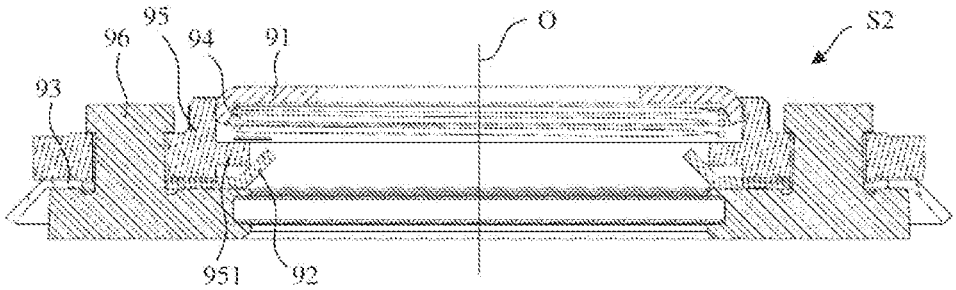
FIG. 16 shows a cross-sectional view of the sealing assembly of the scroll compressor of FIG. 15.

FIG. 15 shows a sectional view of the scroll compressor 200. As shown in FIG. 15, the capacity adjustment device M2 of the scroll compressor 200 has a structure similar to the structure of the capacity adjustment device M of the scroll compressor 1 of the comparative example, and includes a bypass passage 41, an adjusting member 42 and a mounting piece 43. FIG. 16 shows the sealing assembly S2 of the scroll compressor 200. As shown in FIG. 16, the sealing assembly S2 includes a first sealing piece 91, a second sealing piece 92, a third sealing piece 93, a first mounting piece 94, a second mounting piece 95 and a third mounting piece 96. The second sealing piece 92, the third sealing piece 93 and the third mounting piece 96 have the same configurations as the second sealing piece 52, the third sealing piece 53 and the first mounting piece 54 of the sealing assembly S of the scroll compressor 1 of the comparative example, respectively. The second mounting piece 95 is substantially the same as the first sealing piece 51 of the sealing assembly S of the scroll compressor 1 of the comparative example and the difference is that the second mounting piece 95 is provided with an annular flange 951 extending radially inward from the inner wall of the second mounting piece 95, and the upper end of the second mounting piece 95 does not provide a seal with the partition 30. The first sealing piece 91 is a flexible sealing piece, the first mounting piece 94 is a compression spring, the lower end of the first mounting piece is mounted on the annular flange 951 of the second mounting piece 95, and the upper end of the first mounting piece abuts the first sealing piece 91 against the partition 30 to form a first sealing portion. The first sealing piece 91 is sandwiched between the partition 30 and the upper end of the cylindrical portion 213 of the fixed scroll 21. The first sealing portion provides a seal between the high pressure space VH and the low pressure space VL in the scroll compressor 200. The second mounting piece 95 and the third mounting piece 96 are coupled to each other and sandwich the second sealing piece 92 and the third sealing piece 93 therebetween. The inner peripheral edge of the second sealing piece 92 and the outer peripheral wall of the cylindrical portion 213 of the fixed scroll 21 form a second sealing portion. The second sealing portion separates the high pressure space VH and the back pressure chamber B2. The outer peripheral edge of the third sealing piece 93 and the second portion 422 of the adjusting member 42 form a third sealing portion. The third sealing portion separates the back pressure chamber B2 from the low pressure space VL. The sealing surface of the first sealing portion is a flexible sealing surface, which can reduce the contact force required by the sealing portion compared with the scroll compressor 1 of the comparative example, and can set the back pressure (pressure P2) in the back pressure chamber B2 to be relatively small, thereby reducing the axial force on the compression mechanism 20 under the full load condition and reducing the power consumption. It is possible to balance the requirements for the back pressure (pressure P2) in the back pressure chamber B2 under different load operating conditions, improve the system performance, and realize the technical effects similar to those of the scroll compressor 100 according to the first embodiment of the present disclosure. Furthermore, compared with the scroll compressor 100 according to the first embodiment of the present disclosure, the scroll compressor 200 according to the second embodiment of the present disclosure makes fewer modifications on the basis of the scroll compressor 1 of the comparative example.

The exemplary embodiments of the present disclosure have been described in detail here. It should be understood that the present disclosure is not limited to the specific embodiments described and shown in detail herein. Those skilled in the art can make various modifications and variations to the present disclosure without departing from the spirit and scope of the present disclosure. All these modifications and variations fall within the scope of the present disclosure. Moreover, all the members described herein can be replaced by other technically equivalent members.

The invention claimed is:

1. A scroll compressor comprising:

a partition, wherein the partition divides a space inside the scroll compressor into a high pressure space and a low pressure space;

a compression mechanism, wherein the compression mechanism comprises a fixed scroll and a movable scroll, wherein the fixed scroll and the movable scroll cooperate with each other to define a series of compression chambers;

a capacity adjustment device, wherein the capacity adjustment device comprises a bypass passage and an adjusting member, the bypass passage penetrates through an end plate of the fixed scroll, so that a first end of the bypass passage is opened at a first side of the end plate of the fixed scroll to communicate with a first compression chamber of the series of compression chambers and a second end of the bypass passage is opened at the an opposite second side of the end plate of the fixed scroll and selectively communicates with the low pressure space, the adjusting member is configured to be movable in an axial direction relative to the fixed scroll to establish or interrupt communication between the first compression chamber;

a back pressure chamber, wherein the back pressure chamber is formed between the fixed scroll and the partition and communicates with a second compression chamber of the series of compression chambers via a back pressure passage; and a sealing assembly, wherein the sealing assembly separates the back pressure chamber from the high pressure space and the low pressure space, wherein a first sealing portion is formed between the sealing assembly and the partition, and a sealing surface of the first sealing portion is a flexible sealing surface, wherein the capacity adjustment device is provided with a variable pressure chamber and is configured to move the adjusting member in the axial direction relative to the fixed scroll by changing a pressure in the variable pressure chamber.

2. The scroll compressor according to claim 1, wherein at the first sealing portion, a flexible first sealing piece of the sealing assembly is compressed against the partition by a first mounting piece.

3. The scroll compressor according to claim 2, wherein the fixed scroll is provided with a cylindrical portion extending in the axial direction from the second side of the end plate and the cylindrical portion is provided with an outer shoulder portion, wherein the second end of the bypass passage is located at a radially outer side of the cylindrical portion, a first end of the back pressure passage is opened at the first side of the end plate of the fixed scroll to communicate with the second compression chamber, a second end of the back pressure passage is opened at the outer shoulder portion, the adjusting member is an annular member, the adjusting member is sealingly engaged with the cylindrical portion, and the adjusting member is movable relative to the cylindrical portion in the axial direction, the back pressure chamber is jointly defined by the cylindrical portion, the partition and the adjusting member.

4. The scroll compressor according to claim 3, wherein a second sealing portion is further formed between the sealing assembly and the partition and the second sealing portion is located radially outside the first sealing portion, wherein at the second sealing portion, a flexible second sealing piece of the sealing assembly is compressed against the partition by a second mounting piece.

5. The scroll compressor according to claim 4, wherein the second sealing piece is compressed between an end of the second mounting piece and the partition and at least a portion of the second sealing piece is in sealing contact with the adjusting member, wherein an axial distance between the end of the second mounting piece and the partition is d1 and an axial distance between an end of the adjusting member and the partition is d2, wherein $d1>0.7d2$.

6. The scroll compressor according to claim 4, wherein the second mounting piece is mounted on the outer shoulder portion via an annular retainer, wherein the annular retainer is provided with a notch extending radially inward from an outer periphery of the annular retainer, the notch facing the second end of the back pressure passage.

7. The scroll compressor according to claim 4, wherein the cylindrical portion is further provided with an inner shoulder portion and the first mounting piece is mounted on the inner shoulder portion, so that the first sealing portion is located at a radially inner side of the cylindrical portion.

8. The scroll compressor according to claim 3, wherein the sealing assembly further comprises an annular second sealing piece and an annular third sealing piece and comprises a second mounting piece and a third mounting piece coupled to each other, wherein the second sealing piece and the third sealing piece are sandwiched between the second mounting piece and the third mounting piece, and wherein an inner peripheral of the second sealing piece and an outer peripheral wall of the cylindrical portion form a second sealing portion, and an outer periphery of the third sealing piece and an inner peripheral wall of the adjusting member form a third sealing portion.

9. The scroll compressor according to claim 8, wherein the second mounting piece is provided with an annular flange extending radially inward from an inner wall of the second mounting piece, wherein the first mounting piece is mounted on the annular flange.

10. The scroll compressor according to claim 1, wherein the variable pressure chamber is controlled via an electromagnetic switching valve to selectively communicate with the low pressure space or communicate with the back pressure chamber.

11. The scroll compressor according to claim 10, wherein when the variable pressure chamber is controlled to communicate with the low pressure space, the adjusting member covers the second end of the bypass passage to interrupt the communication between the first compression chamber and the low pressure space, so that the scroll compressor operates at full load condition;

when the variable pressure chamber is controlled to communicate with the back pressure chamber, the adjusting member opens the second end of the bypass passage to establish the communication between the first compression chamber and the low pressure space, so that the scroll compressor operates at partial load condition.

* * * * *